US006619619B2

(12) United States Patent
Boisdequin et al.

(10) Patent No.: US 6,619,619 B2
(45) Date of Patent: Sep. 16, 2003

(54) CLAMPING DEVICE FOR A REFRACTORY-MADE PLATE OF A SLIDING GATE

(75) Inventors: Vincent Boisdequin, Naast (BE); Philippe Mutsaarts, Obourg (BE)

(73) Assignee: Vesuvius Crucible Company, Wilmington, DE (US)

( * ) Notice: Subject to any disclaimer, the term of this patent is extended or adjusted under 35 U.S.C. 154(b) by 0 days.

(21) Appl. No.: 10/220,653

(22) PCT Filed: Mar. 26, 2001

(86) PCT No.: PCT/BE01/00051

§ 371 (c)(1),
(2), (4) Date: Sep. 3, 2002

(87) PCT Pub. No.: WO01/72453

PCT Pub. Date: Oct. 4, 2001

(65) Prior Publication Data

US 2003/0038268 A1 Feb. 27, 2003

(30) Foreign Application Priority Data

Mar. 29, 2000 (EP) ..... 00870058

(51) Int. Cl.[7] ..... B22D 41/34
(52) U.S. Cl. ..... 251/327; 222/600
(58) Field of Search ..... 222/600, 597, 222/561; 266/236; 251/326, 327

(56) References Cited

U.S. PATENT DOCUMENTS 4,141,478 A * 2/1979 Meier ..... 222/600
4,524,956 A * 6/1985 Bachmann ..... 222/600 X
4,573,616 A * 3/1986 Shapland ..... 222/600
4,582,232 A * 4/1986 Shapland et al. ..... 222/600
4,627,147 A * 12/1986 Kagi ..... 222/600 X
4,840,296 A 6/1989 Otsuka et al.
5,482,192 A * 1/1996 Sato et al. ..... 222/600
5,626,164 A * 5/1997 Richard et al. ..... 222/600 X
5,698,129 A * 12/1997 Keller et al. ..... 222/600
6,092,701 A * 7/2000 Waltenspuhl et al. ..... 222/600

FOREIGN PATENT DOCUMENTS

DE 19611210 A1 9/1997
EP 0222070 A1 5/1987

* cited by examiner

*Primary Examiner*—Gene Mancene
*Assistant Examiner*—Eric Keasel
(74) *Attorney, Agent, or Firm*—Robert S. Klemz; James R. Williams; Donald M. Satina

(57) ABSTRACT

The object of the present invention is a clamp for clamping device for a refractory plate in a seating of a slide valve in a casting installation, the said clamp having on one hand a thrust zone whereon it can receive a clamping force tending to push the clamp against a refractory plate located in the seating and, on the other hand, two ends of which each is capable of being applied against one edge of the refractory plate. The clamp is characterised in that it is capable of being elastically deformed in that each of its two ends is conformed such that it bears against the corresponding edge of the refractory plate when a clamping force is applied to the clamp also bears against the wall of the seating under the effect of expansion of the plate or a greater clamping force. One of the advantages of the clamp, and in that the clamp is also deformed such that the clamp according to the invention is that it adapts automatically to the geometry of the plate which it is required to immobilise, so that variations in shape between plates due to their fabrication process do not cause any clamping problems.

13 Claims, 3 Drawing Sheets

CLAMPING DEVICE FOR A REFRACTORY-MADE PLATE OF A SLIDING GATE

Figure 1:
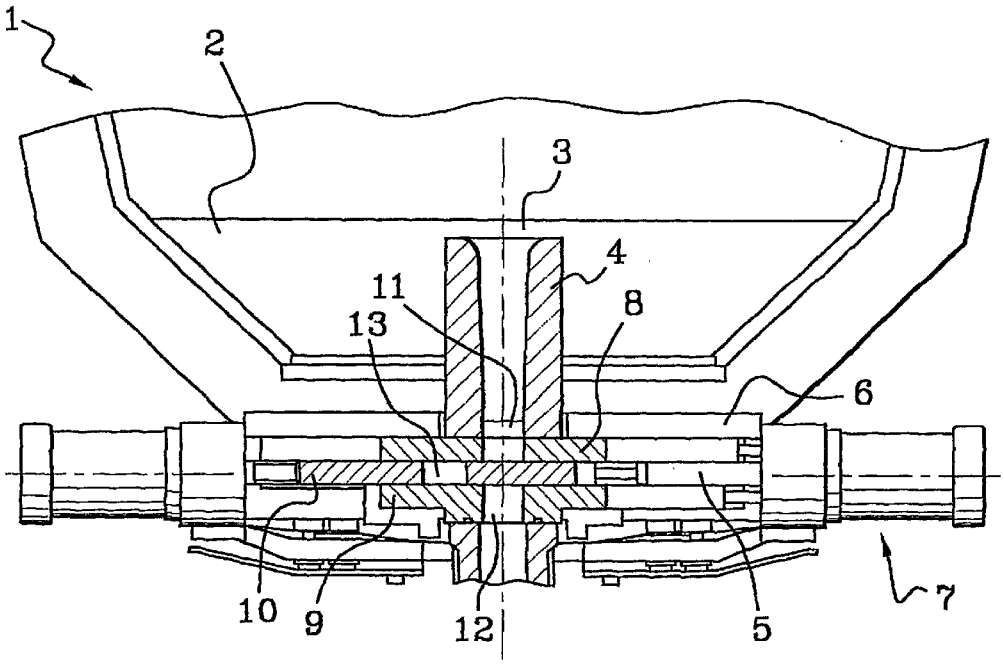

The present invention relates to a clamp for a clamping device for a refractory plate in a seating of a slide valve in a casting installation, an assembly comprising a refractory plate and its seating, a slide valve incorporating such an assembly, a casting installation incorporating such a slide valve and a process for clamping a refractory plate.

It is known that the refractory plates used in slide valves in metallurgical casting installations are mounted in their seatings by clamping.

These seatings may take the form of fixed elements on the valve frame in the case of fixed plates, or carriages for the mobile plates of the slide valve.

Clamping is generally carried out by means of a clamp which, on one hand, bears against one edge of the plate and, on the other hand, against an adjustable stop which serves to press the clamp against the plate in order to immobilise it.

With known clamps, the plate is held in its seating in a satisfactory manner. However, a notable difficulty is posed by the variability in shape between plates, which may be due to the fabrication process or required for various reasons. This variability can give rise to imbalances in the bearing contact between the clamp and plate, resulting in the application of very high localised forces.

In the long term, these elevated stresses can damage both the clamp and the plate, which is already subject to cracking by virtue of its normal duty.

The present invention has the purpose notably of providing a clamp which does not have the shortcomings of known clamps.

The object of the present invention is a clamp for a clamping device for a refractory plate in a seating of a slide valve in a casting installation, the said clamp having on one hand a thrust zone whereon it can receive a clamping force tending to push the clamp against a refractory plate located in the seating and, on the other hand, two ends of which each is capable of being applied against one edge of the refractory plate, characterised in that the clamp is capable of being elastically deformed and in that each of the two ends of the clamp is also conformed such that it bears against an adjacent wall of the seating under the effect of a suitable clamping force (and greater than the force required to cause the clamp to bear solely on the edges of the plate), or under the effect of thermal expansion of the plate due to the high temperatures observed during casting operations, or under the combined effect of these two actions.

The document EP-A1-220,070 discloses a clamping mechanism for a plate into a support frame. This clamping mechanism includes a stirrup or U shaped clamp adapted to the peripheral profile of an end face of the refractory plate. The stirrup or U-shaped clamp has adjustment means and guides for adjustment parallel to the peripheral profile of the refractory plate. As the stirrup does not bear simultaneously on the refractory plate and on the support frame (FIG. 2), the clamping can only be assured by the clamp itself which has to be made of a rigid material. When, in use, the plate is brought to high temperature and expands, extremely high local stresses are generated in the plate since the stirrup or U shaped clamp is made of material which has no elasticity at all. On the other hand, if the plate is not immediately clamped, assuming there is a possibility to clamp the plate later while the plate is already in use and hot, there is a risk of movement of the plate in its support frame. Such a movement could be catastrophic for the safety and security of the personnel and installation.

One of the advantages of the clamp according to the invention is that it adapts automatically to the geometry of the plate which it is required to immobilise. Thus, variations in shape between plates due to the fabrication process do not cause any clamping problems. Similarly, the ability of the clamp to conform automatically to the bearing surfaces presented by the plate, by virtue of its elasticity, avoids the clamp itself being subjected to unduly high stresses and eventually breaking.

In this way, by virtue of its elasticity, the clamp according to the invention itself absorbs some of the deformation of the plate due to its expansion and then, during casting operations, transmits to the plate seating the clamping forces exerted by the adjustable stop and by the deformation due to expansion of the plate.

In other words, the clamp behaves like a self-positioning brace between the plate and its seating.

In regard to elastic deformation of the clamp, the following factors will be taken into account: advantageously, a clamp with a rigidity constant below 10 T/mm will be selected, preferably below 5 T/mm, and even more preferably in the order of 1 to 3 T/mm. These values may be compared with those measured on known clamps, which range from 10 to 30 T/mm, or even higher. Hitherto, it has always been considered that the clamp, when present, must have sufficient rigidity for the plate to be acted upon directly when the slide valve is set in motion, without allowing the slightest amount of play to develop. In this situation, it is necessary for the rigidity constant of the clamps in question to be at least greater than 10 T/mm, and generally greater than 20–30 T/mm.

Departing from known principles, the inventors opted for a considerably less rigid clamp whose elasticity absorbs some of the expansion of the plate without generating large stresses until the moment when the ends of the clamp come into contact with and bear against the walls of the seating (which generally have a rigidity constant greater than 40 T/mm, and even in the order of 150 to 200 T/mm in the case of certain ladle slide valves). The clamp then simply acts as a brace between the plate, which at this point has almost reached its maximum size, and the seating. As the plate has almost reached its maximum size when the ends of the clamp begin to bear against the walls of the seating, the stresses generated in the plate are very substantially reduced.

Advantageously, however, the clamp must not absorb all of the deformation due to thermal expansion of the plate so that the latter remains in compression during the casting operations. Indeed, it is beneficial for the plate to be maintained in compression so that any cracks which may develop are held closed.

Advantageously, the clamp is fabricated in one piece by machining, casting or forging in a material possessing the requisite properties having regard to the temperature conditions, mechanical strength and elasticity of the clamp. Examples of suitable materials for fabrication of the clamp according to the invention are all types of steel, in particular steel 42CrMo4.

In a particular embodiment, at least one of the two ends of the clamp is connected to the thrust zone by an elastically deformed portion of the clamp, allowing the orientation of the end to be changed.

This change of orientation allows the said end to bear against the plate over a surface contact thereby avoiding the application of punctual forces detrimental for the plate.

The second bearing surface, which is rounded, serves as a "pivot" allowing the contact made between the end of the clamp and the plate to impose the orientation of the said end, so that the contact thus made is a surface-type contact.

In a particular mode of implementation, the clamp includes only one thrust zone. The clamping force applied by an adjustable stop in the seating is thus automatically distributed between the two ends of the clamp thereby avoiding any imbalance between the clamping forces applied by the two ends of the clamp on the plate.

Preferably, the thrust zone presents a smooth surface (which may be flat or rounded) to make contact with the adjustable stop in the seating, which can apply its clamping force at any point on this smooth surface. In this way, the clamp is able to assume a balanced position between the seating and the clamp, possibly by deflecting away from the longitudinal axis of the seating by reason of asymmetry in the plate, without disturbing the bearing contact between the adjustable stop of the seating and the thrust zone.

In a particular mode of implementation, at least one of the ends of the clamp incorporates, in cross section, a cut-out enabling the said end to engage under a projection in the wall of the seating.

This projection serves to prevent the clamp from dropping out of the seating when the clamping force on the plate is released.

The object of the invention is also an assembly of a refractory plate and its seating, in the form of a carriage or a fixed element on the valve frame, incorporating a seating to accommodate the said refractory plate, characterised in that the refractory plate is held in the seating by means of a clamp as described above.

According to a particular mode of implementation of the invention, the carriage or fixed element of the valve frame is provided with a clamping arrangement to exert the clamping force on the clamp. This clamping arrangement consists of a screw, a cam, a thrust block or any other variant known to the person skilled in the art.

Advantageously, this clamping arrangement is removable so that, in case it becomes stuck in the clamped position, it can be readily detached from the assembly.

The invention also relates to a slide valve in a casting installation incorporating such an assembly, and to a casting installation.

The present invention also relates to a process for clamping a plate in a seating of a slide valve in a casting installation, comprising the step of placing a clamp between the plate and one edge of the seating, the said clamp having, on one hand, a thrust zone whereon a clamping force can be exerted so as to push the clamp against a plate located in the seating and, on the other hand, two ends of which each is capable of being applied against one side of the plate, characterised in that a clamping force is applied to the clamp causing it to deform elastically until each end of the clamp bears against the corresponding edge of the plate, preferably until the ends of the clamp are sufficiently close to the wall of the seating to be able to bear thereon when the plate expands under the effect of the temperature reached during casting.

Figure 2:
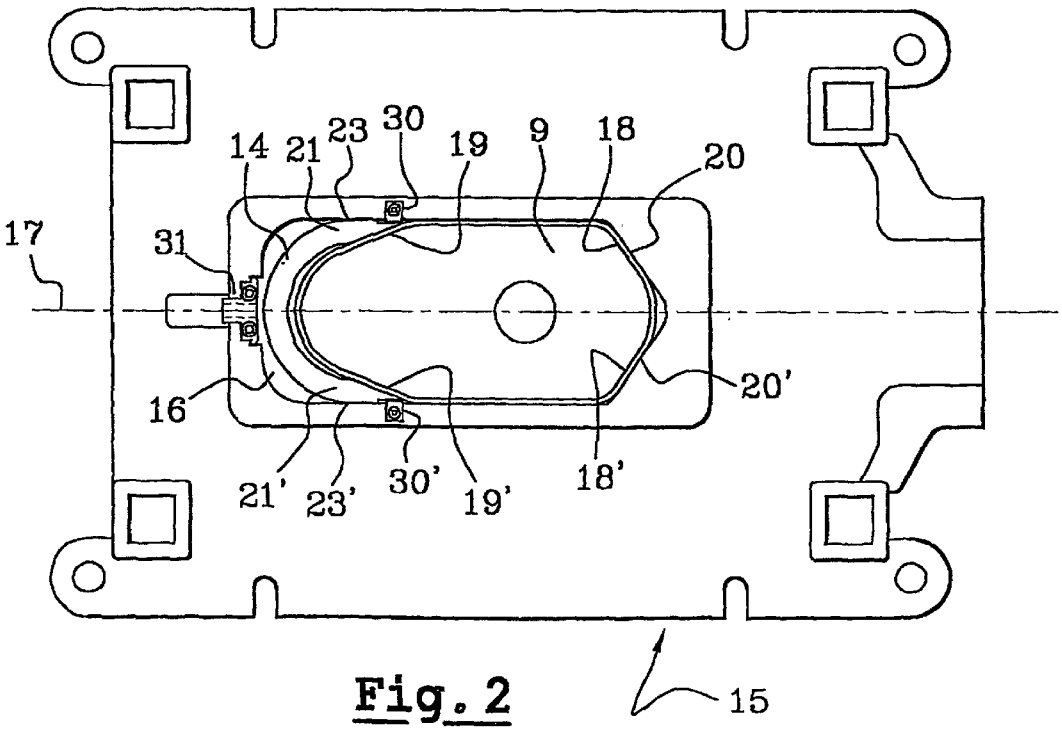
Figure 3:
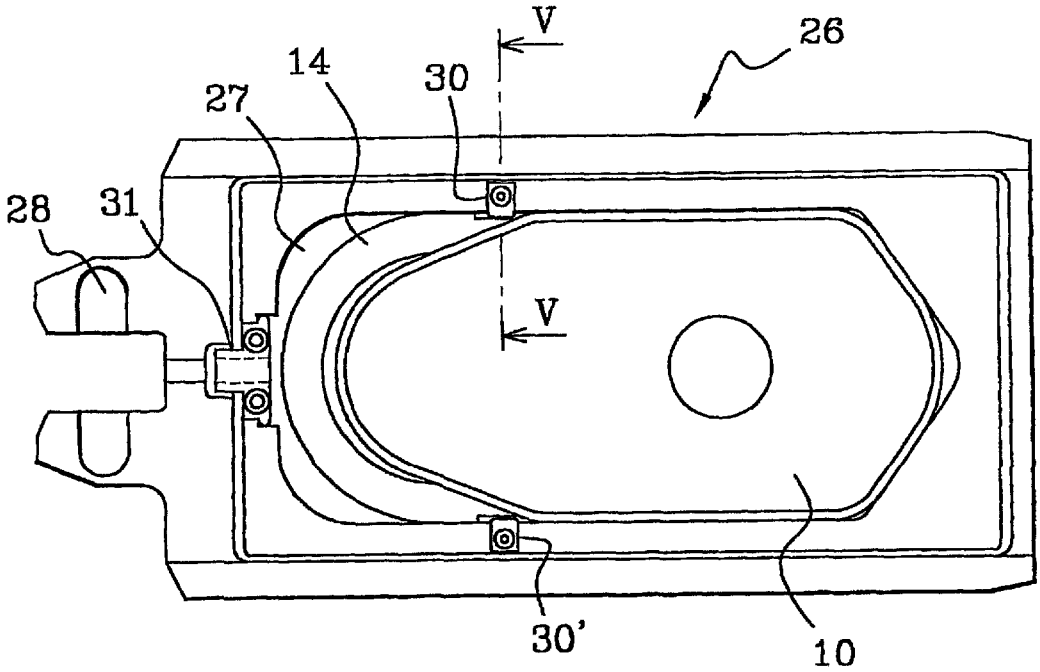
Figure 4:
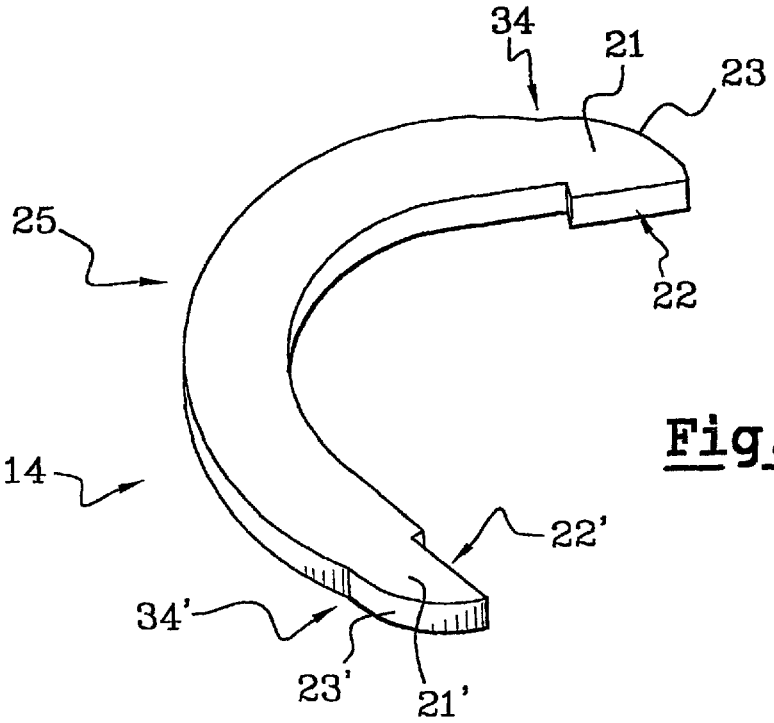
Figure 5:
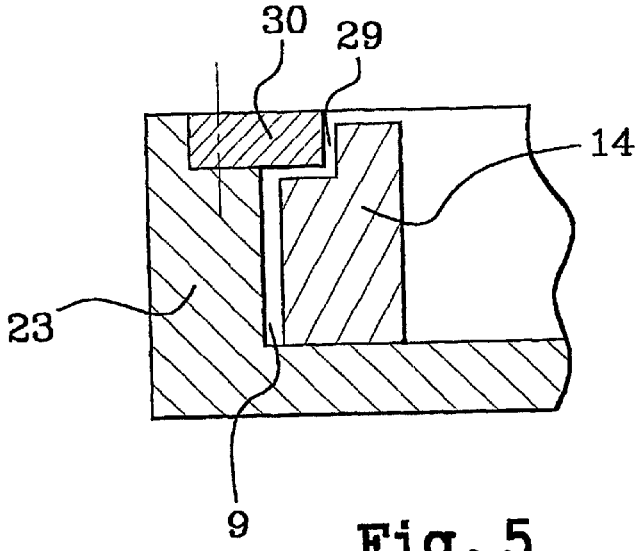
Figure 6:
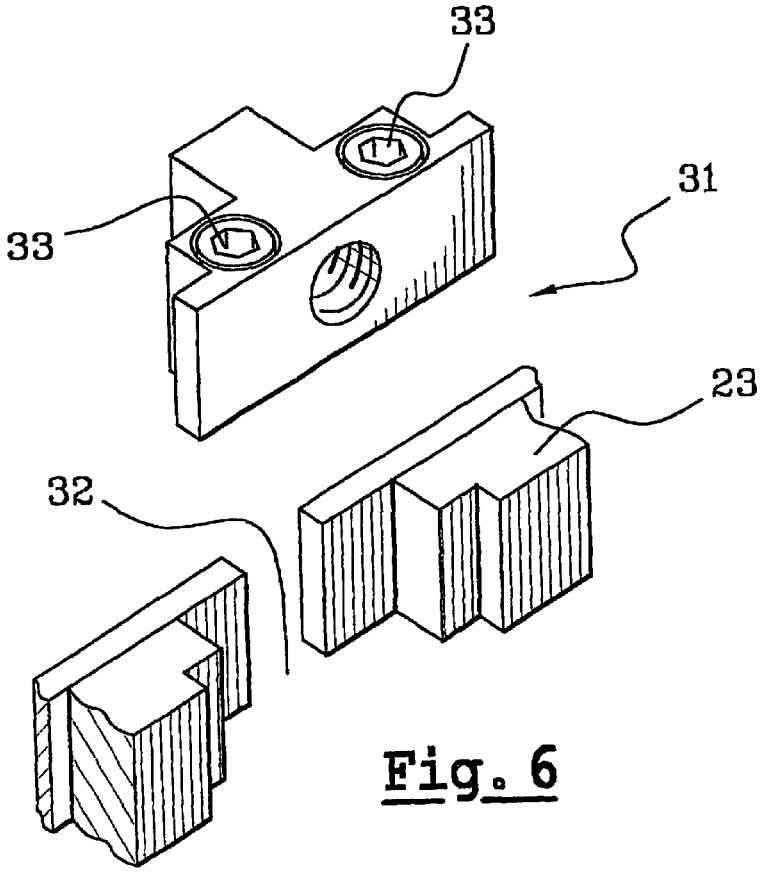

In order to better explain the invention, a method of implementation given by way of a non-limitative example is described below with reference to the attached drawings in which:

FIG. 1 is an axial cross-section on part of the bottom of a metallurgical vessel fitted with a slide valve;

FIG. 2 is a view on arrow II of a fixed element of the valve frame shown in FIG. 1, FIG. 3 is a view on arrow II of the mobile carriage in FIG. 1, FIG. 4 is a perspective view on one of the clamps in FIGS. 1 to 3, FIG. 5 is a sectional view on V—V in FIG. 3, FIG. 6 is an exploded perspective view of the adjustable stop system on the mobile carriage In FIG. 1, the metallurgical vessel 1 includes a bottom 2 having a pouring orifice 3. The latter incorporates an inner nozzle 4 passing through the vessel bottom and the bottom plate 6 of the valve frame. A slide valve 7 is mounted on the vessel in register with the pouring orifice 3. This valve includes two fixed refractory plates—upper 8 and lower 9 —and a mobile refractory plate 10 designed to slide between the two fixed plates under the action of a cylinder 5. It will not be noted that FIG. 1 shows a slide valve with three plates. It is to be understood that the present invention also relates to two-plate arrangements or to arrangements in which one plate and another casting component (tube or inner nozzle for example) form an assembly.

Each of the plates 8, 9 and 10 is traversed by a pouring orifice 11, 12 and 13 having essentially the same cross-sectional area as that of the inner nozzle. The regulation or interruption of casting is effected, in a known manner, by moving the mobile plate 10 so as to modify the size of the orifice resulting from alignment of the pouring orifices in the three plates. In the example shown in FIGS. 2 and 3, each of the plates 8, 9 and 10 is circled. It is mounted in its seating by clamping with the aid of a U-shaped clamp 14, as shown in FIG. 4. The fixed plate 8 is clamped into a fixed element on the valve frame (not shown), the fixed plate 9 is clamped into a slide valve cover, visible in FIG. 2, and the moving plate 10 is clamped into a mobile carriage shown in FIG. 3. The cover 15 in FIG. 2 includes a number of peripheral arrangements which are not described here as they are not necessary in order to understand the invention. In its central part, the cover incorporates a recess 16, having sensibly the same thickness as the refractory plate 9, which accommodates this plate and the clamp 14.

The plate 9 is elongated in shape and is contained within a rectangle with four truncated corners as described for example in European Patent application EP 99870258.3 or in document WO 98/05451. The plate is immobilised in its seating by its four edges forming the truncated corners of the rectangle. The edges 18 and 18' bear against the fixed stops 20 and 20', whilst the edges 19 and 19' are supported by the ends 21 and 21' of the clamp 14.

As can better be seen in FIG. 4, each end 21, 21' of the clamp includes a first bearing surface formed by an internal flat face 22, 22' which bears on one edge 19, 19' of the plate, and a second bearing surface formed by a rounded surface 23, 23' opposite the flat face 22, 22', which is designed to bear against the edge 24, 24' of the seating 16 formed in the cover 15. The rounded form of the surface 23, 23' ensures linear contact with the side 24, 24' of the seating, so that no particular orientation of the end 21, 21' of the clamp is favoured in bearing against the said edge. Thus, by virtue of its contact against the flat edge 19, 19', the flat face 22, 22' is able to impose an orientation on the end 21, 21' such that the contact so formed is a surface-type contact. Each end 21, 21' is connected to the clamp body by a reduced cross-section zone 34, 34' which imparts improved elastic deformability to this area of the clamp, thereby producing the correct orientation of each end relative to the plate.

As well as this local elasticity of the clamp at its ends, the clamp 14 is also deformed by the inward or outward movement of its two arms, which also occurs in an elastic manner. It is thus able to adapt precisely to the shape of the plate, by engaging its two ends between the side 24, 24' of the seating and each side 19, 19', with each end 21, 21' assuming the optimal individual orientation, as just described.

FIG. 3 illustrates the mobile carriage 26 supporting the mobile plate 10. Apart from various peripheral arrangements which will not be described here, the carriage incorporates a seating 27 in its central part to accommodate the mobile plate 10 immobilised by a clamp 14. The carriage translation motion is powered by a cylinder 5 of which the piston rod engages in a recess 28 provided for this purpose. On the fixed element of the frame 15 and on the mobile carriage 26, the clamp is held in the seating by its two ends, even when no clamping force is being applied, by means of a cut-out 29 in each end 21, 21' and a projection 30, 30' integral with the edge 24, 24' of the seating, as illustrated in FIG. 5. The clamp 14 can only be disengaged from the seating by sliding its two ends 21, 21' out of the projections, which is impossible whilst the mobile stop pushing the clamp against the plate remains in place, even when no force is being applied to this mobile stop.

FIG. 6 provides a detailed view of an example of the mobile stop. The latter is made up of a threaded part 31 which slots into a recess 32 provided for this purpose in the side of the seating, in the longitudinal axis of the seating. Once engaged, the threaded part 31 is secured in the slot by means of fixing screws 33. It can accommodate a retaining screw (not shown) which extends to the inside of the seating and bears against the external smooth face 25 (FIG. 4) of the thrust zone of the clamp.

Given that this face 25 is cylindrical and smooth, there is no preferential bearing point for the screw against the said face, which enables the clamp to assume the most appropriate position to secure the plate, this position being determined solely by the bearing contact of its ends 21, 21' between the sides 19, 19' and side 24, 24'.

The single force exerted by the clamp retaining screw is automatically balanced between the two ends 21, 21', ensuring that the plate is secured in its seating. In another mode of implementation not shown, the screw may be replaced by a cam.

It is to be understood that the modes of implementation described are in no way limitative and that they may undergo any modifications as may be desirable without falling beyond the scope of the invention.

REFERENCES

1. metallurgical vessel
2. vessel bottom wall
3. pouring orifice
4. inner nozzle
5. cylinder
6. fixed element of valve frame (bottom plate)
7. slide valve
8. upper fixed plate
9. lower fixed plate
10. intermediate mobile plate
11. upper plate tap hole
12. lower plate tap hole
13. intermediate plate tap hole
14. clamp
15. fixed element of valve frame (cover)
16. seating
17. longitudinal axis
18. edges of plate in contact with fixed stop
19. edges of plate in contact with clamp
20. fixed stops
21. clamp ends
22. flat bearing surfaces of clamp formed by the inner faces
23. rounded bearing surfaces of clamp formed by the outer faces
24. edges of seating in contact with clamp
25. thrust zone
26. mobile carriage
27. carriage seating
28. recess to accommodate cylinder head
29. cut-out in clamp
30. projections
31. threaded piece
32. cut-out
33. fixing screw
34. reduced-section zone

What is claimed is:

1. A clamp for securing a refractory plate in a seating of a sliding gate valve of a casting installation, the refractory plate including at least two edges and the seating including a wall, the clamp having a rigidity constant below 10 T/mm, adapted to deform elastically, and comprising:

a. at least one thrust zone for receiving a clamping force and tending to push the clamp against the refractory plate;

b. at least two ends connected by the thrust zone and capable of being applied against edges of the refractory plate when the thrust zone receives a clamping force, whereby each end of the clamp is adapted to bear against the wall of the seating under the effect of a suitable force.

2. The clamp of claim 1, wherein the clamp comprises one piece.

3. The clamp of claim 1, wherein at least one end of the clamp connects to the thrust zone by an elastically deformed portion of the clamp, whereby an orientation of the end may be changed.

4. The clamp of clamp 1, wherein at least one end of the clamp comprises, in transverse cross-section, a cut-out allowing the end to engage under a projection in the wall of the seating.

5. The clamp of claim 1, wherein at least one end includes a flat bearing surface adapted to bear against the edge of the refractory plate and a rounded bearing surface adapted to bear against the wall of the seating.

6. The clamp of claim 1, wherein the clamp has only one thrust zone.

7. The claim of claim 6, wherein the thrust zone presents a smooth surface for the application of a clamping force at any point on the smooth face.

8. An assembly comprising a refractory plate, a valve element defining a seating and accommodating the refractory plate, and a clamp to secure the refractory plate in the seating, the clamp having a rigidity constant below 10 T/mm, adapted to deform elastically and comprising:

a. at least one thrust zone for receiving a clamping force and tending to push the clamp against the refractory plate;

b. at least two ends connected by the thrust zone and capable of being applied against edges of the refractory plate when the thrust zone receives a clamping force, whereby each end of the clamp is adapted to bear against the wall of the seating under the effect of a suitable force.

9. The assembly of claim 8, wherein the valve element includes a clamping arrangement to exert the clamping force on the clamp, the clamping arrangement comprising at least one element selected from the group consisting of a screw, a cam and a thrust block.

10. The assembly of claim 8, wherein a slide gate valve comprises the assembly.

11. The assembly of claim 8, wherein the assembly is located between an upper metallurgical vessel and a lower metallurgical vessel.

12. A method for clamping a plate in a slide gate assembly for a casting installation, the slide gate assembly comprising a valve element defining a seating having at least one wall, a refractory plate having at least two edges, and an elastic clamp having a rigidity constant below 10 T/mm and comprising at least two ends connected by a thrust zone, the method comprising:

a. seating the refractory plate in the seating;

b. placing the clamp between the plate and the wall of the seating;

c. applying to the thrust zone a clamping force sufficient to deform the clamp elastically until the ends of the clamp bear against the edges of the plate and until the ends of the clamp are sufficiently close to the walls of the seating so that the ends may bear on the walls when the plate expands under the effect of temperature.

13. The method of claim 12, further comprising applying the clamping force at a single point on the clamp.

* * * * *